United States Patent [19]

Knapp

[11] Patent Number: 4,991,500

[45] Date of Patent: Feb. 12, 1991

[54] REFUSE COMPACTOR DEVICE

[76] Inventor: James S. Knapp, 911 Royal Oak Dr., Louisville, Ky. 40272

[21] Appl. No.: 363,671

[22] Filed: Jun. 8, 1989

[51] Int. Cl.[5] ..... B30B 9/00; B30B 5/00

[52] U.S. Cl. ..... 100/90; 100/227; 100/229 A; 100/240; 100/245; 100/295; 215/231; 220/908

[58] Field of Search ..... 100/226, 227, 240, 245, 100/246, 247, 248, 90, 295, 229 A; 220/1 T; 248/95, 99; 215/231

[56] References Cited

U.S. PATENT DOCUMENTS

| | | | |
|---|---|---|---|
| 1,353,104 | 9/1920 | Wetsler | 215/231 |
| 2,091,212 | 8/1937 | McNeil | 215/231 |
| 3,451,453 | 6/1969 | Heck | 220/1 T X |
| 3,836,037 | 9/1974 | Bass | 220/1 T X |
| 3,863,563 | 2/1975 | Popeil | 100/245 X |
| 4,050,373 | 9/1977 | Hellmann | 100/240 |
| 4,128,055 | 12/1978 | Hellmann | 100/245 |
| 4,331,074 | 5/1982 | Behman | 100/245 X |
| 4,349,123 | 9/1982 | Yang | 220/1 T X |
| 4,416,197 | 11/1983 | Kehl | 100/245 X |
| 4,427,125 | 1/1984 | Tuitt | 215/231 |
| 4,593,615 | 6/1986 | Kehl | 100/245 X |
| 4,649,813 | 3/1987 | Kehl | 100/245 X |
| 4,658,720 | 4/1987 | Massonnet | 100/246 X |

FOREIGN PATENT DOCUMENTS

| | | | |
|---|---|---|---|
| 2915349 | 10/1980 | Fed. Rep. of Germany | 100/240 |
| 3701363 | 9/1988 | Fed. Rep. of Germany | 220/1 T |
| 8501293 | 12/1986 | Netherlands | 100/227 |

*Primary Examiner*—Harvey C. Hornsby
*Assistant Examiner*—Stephen F. Gerrity
*Attorney, Agent, or Firm*—Charles G. Lamb

[57] ABSTRACT

A refuse compactor device has a container housing having an open top end for holding a trash bag in which the bag mouth is in registration with and folded over the open top end of the container for receiving trash to be compacted. The compactor device further includes a compactor plate received within the container housing for manual movement from the open top end of the housing toward the bottom end of the housing to compress refuse material in the trash bag. The housing has ventilation apertures in its side wall and bottom to allow air trapped between the bag and the side walls of the housing to be expelled from the container. The compactor plate also has ventilation apertures to allow air included in the refuse to be expelled from the container as the plate is moved into the trash bag and housing. The compactor plate further has an opening to receive therethrough the mouth end of the bag for convenient closing of the bag mouth.

5 Claims, 1 Drawing Sheet

REFUSE COMPACTOR DEVICE

BACKGROUND OF THE INVENTION

1. Field of the Invention

The present invention relates to refuse compactor devices such as leaves and grass clippings to be used by a householder, and for disposition of other waste materials such as shredded paper in commercial applications.

2. Discussion of the Prior Art.

At this time, in most communities, a householder cannot burn leaves or grass clippings because of environmental pollution problems. Therefore, it is conventional practice to place the leaves and grass clippings in trash bags, particularly plastic trash bags to be collected by refuse collectors for disposal at approved sites.

It is also conventional practice to collect other refuse such as shredded paper in plastic bags, without compaction of the refuse. This results in an inefficient use of the plastic bags because, if the refuse were compacted, more of it could be included in the bag.

One problem with the use of such flexible trash bags is that they are, of course, not self supporting and, therefore, are difficult to use by an individual because the person must hold the bag open while filling with refuse. Another problem with the trash bags is that it is difficult for an individual to compress the refuse in the bag.

These two problems have been addressed in the prior art. For example, the following seven U.S. Patents disclose different apparatus and devices for supporting a trash bag and compacting the refuse in the bag.

U.S. Pat. No. 1,372,190 teaches an apparatus for compacting pulverized material which includes a rigid walled chamber having a sealable top. A flexible receptacle is placed in the chamber, and a bag containing pulverized material (example carbon black) is placed in the receptacle. Air is evacuated from the chamber which also therefore evacuates the bag of pulverized material. The area outside the flexible receptacle is then pressurized with air which causes the receptacle to compress around the bag of pulverized material thereby compacting the pulverized material in the bag.

U.S. Pat. No. 1,953,042 teaches a bag emptying device which is used to empty bags of granular material without permitting refuse collected on the outside of the bag from mixing with the contents of the bag being emptied. The device includes a casing or canister in which the bag is placed. The mouth of the bag is folded over the lip of the canister opening and is secured in place by a wire ring.

U.S. Pat. No. 3,438,322 teaches a refuse press for compacting refuse, such as leaves, in a disposable bag. The refuse press includes a container in which a bag is placed. The mouth of the bag is folded over the opening of the container and is held in place by a hoop. A presser disc is sized to fit into the container. The presser disc is moved into the container by a lever arm mechanism. As the presser disc is moved into the container it compresses the leaves in the bag.

U.S. Pat. No. 3,528,366 teaches an apparatus for compacting rubbish. The apparatus includes an open top container. A removable bag for the refuse is placed in the container. Refuse is placed in the bag and the container is raised toward a stationary compactor head which is received in the container as it is being raised to compress the refuse in the bag.

U.S. Pat. No. 3,727,546 teaches a garbage compactor including a sleeve which fits inside a garbage bag. A pressure plate moves into the sleeve to compress or compact the garbage in the bag. The sleeve protects the bag from damage from sharp cornered objects.

U.S. Pat. No. 3,850,094 teaches a trash compactor and receptacle wherein the receptacle is provided with a portion of its wall hinged so that the portion of the wall can be swung out to open the receptacle. A trash bag is positioned in the receptacle with the lip of the bag folded over the receptacle rim. A string encircles the folded over lip of the bag to hold it in place. A movable disc is moved downwardly into the receptacle and bag by a lever arm mechanism to compress the trash in the bag.

U.S. Pat. No. 4,200,127 teaches a leaf bagging device which includes a blanket 10 having a large hole 15 at its geometric center. The blanket 10 is spread on the ground for the collection thereon of leaves. The blanket is formed into a funnel shape with the hole 15 defining the mouth of a trash bag. Clamps 21 and 25 are used to fasten the blanket to the bag mouth. The leaves then pass through the hole 15 in the blanket into the bag.

SUMMARY OF THE INVENTION

The present invention provides a trash bag holder and refuse compactor device which is simpler in construction than the prior art devices known to me and is more convenient to use.

More particularly, the present invention provides a refuse compactor device comprising a rigid container housing having a bottom and a peripheral side wall extending upwardly from the perimeter of the bottom, the top edge of the side wall defining an open top into the interior of the container for holding a flexible bag therein with the open mouth of the bag in registration with the open top end and folded over the top edge of the container side wall, ventilation apertures formed through the peripheral side wall of the container to expel air caught between the bag and container wall, a compactor plate having a peripheral configuration matching the peripheral configuration of the open top end of the container to be received within the container and movable from the open top end toward the bottom end of the container, ventilation apertures formed through the compactor plate to expel air included in the refuse in the container as the plate is moved into the container, and an opening through the plate to receive therethrough the gathered mouth end of the bag as the plate is moved into the container.

BRIEF DESCRIPTION OF THE DRAWINGS

A better understanding of the invention will be had upon reference to the following description in conjunction with the accompanying drawings in which the numerals refer to like parts throughout the several views and wherein.

DETAILED DESCRIPTION OF THE PREFERRED EMBODIMENT

Figure 1:
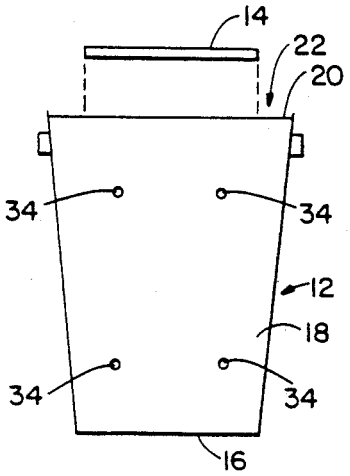
FIG. 1 is an exploded side view of the refuse compactor device of the present invention.

With reference to FIGS. 1, 4, 5, and 6, there is shown a refuse compactor device, generally denoted as the numeral 10, of the present invention. The compactor device 10 includes a container housing 12 and a compactor plate 14 removably received within the container housing 12.

The container 12 is fabricated of a structural material such as plastic. The material may be rigid, but preferably is somewhat flexible to withstand impacts without breaking. The container housing 12 has a bottom end 16 and a peripheral side wall 18 extending upwardly from the perimeter of the bottom 16. The bottom end 16 and side wall 18 are preferably of unitary construction. The top edge 20 of the side wall 18 defines an open container top 22. The side wall 18 also is tapered from the open container top 22 to the perimeter of the container bottom 16. Preferably, the container side wall 18 has a generally rectangularly shaped perimeter.

Figure 2:
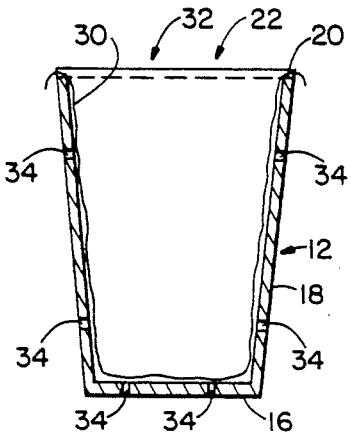
FIG. 2 is a cross-sectional side view of a container component of the device of FIG. 1 including a trash bag installed therein.

Now with reference to FIG. 2, there is shown in side view cross-section the container housing 12 having a plastic trash bag 30 installed therein. The open bag mouth 32 is positioned in registration with the open top end 22 of the container housing 12 and is folded over the top edge 20 of the container side wall 18 to hold the bag 30 mouth open and hold the bag 30 in the container 12.

The container housing 12 is formed with ventilation apertures 34 through its bottom 16 and side wall 18 through which air which may be trapped between the bag 30 and container bottom 16 and side wall 18 is expelled allowing the bag 30 to overlay the container bottom 16 and side wall 18.

Figure 3:
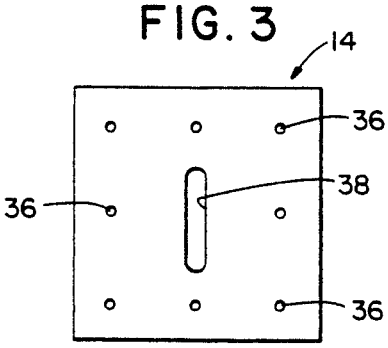
FIG. 3 is a plan view of a compactor plate component of the device of FIG. 1.

Now with reference to FIGS. 1 and 3, the compactor plate 14 has a peripheral configuration substantially conforming to the peripheral configuration of the container side wall 18. The compactor plate 14 is horizontally received within the top section of the container housing 12 for movement from the open container top 22 toward the container bottom 16. Toward this objective, the perimeter of the compactor plate 14 is somewhat smaller than the perimeter of the container side wall 18 proximate the bottom 16. As can be best seen in FIG. 3, the compactor plate 14 is formed with ventilation apertures 36 through which air which may be included in the refuse in the bag 30 is expelled as the compactor plate 14 is moved toward the container bottom 16. In addition, the compactor plate 14 is formed with a central opening 38 to receive the gathered mouth end 32 as the compactor plate 14 is moved downwardly in the container 12 during a bag closing phase of the use of the refuse compactor device 10 as will hereafter be described.

Figure 4:
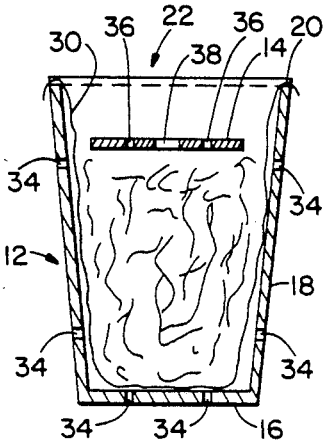
FIG. 4 is a cross-sectional side view of the refuse compactor device with a compactor plate in place after filling of the compactor device with refuse, but prior to compacting the refuse.
Figure 5:
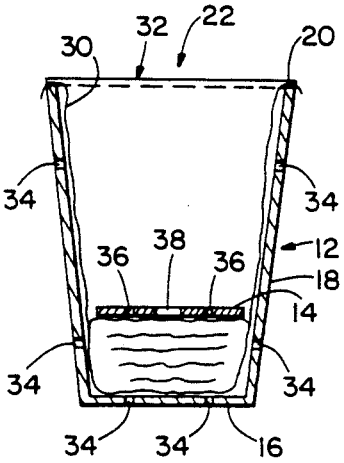
FIG. 5 is a cross-sectional side view of the refuse compactor device with the compactor plate shown in a position compacting the refuse; and, FIG. 6 is a cross-sectional side view of the refuse compactor device with the compactor plate in use for closing the open bag mouth.
Figure 6:
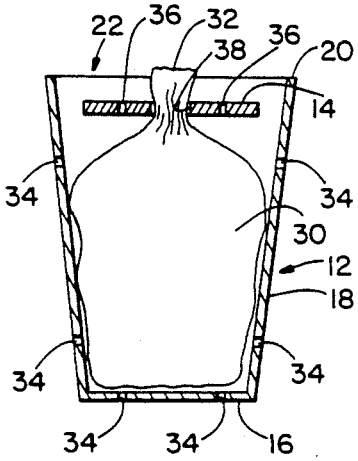

Now with reference to FIGS. 2, 4, and 5, to use the compactor device 10 the compactor plate 14 is removed and the trash bag is installed in the container 12 with the bag mouth folded over the top edge 20 of the container side wall 18. Refuse, such as leaves, grass clippings or shredded paper, and the like, can be placed into the bag 30 held in the container 12 while the container 12 is in an upright position. Alternatively, and due to the rectangular transverse cross-sectional shape of the container 12, in order to reduce the amount of bending and stooping otherwise required when filling the bag in the upright container 12, the container 12 can be positioned on its side wall 18 and the leaves or grass clippings are swept or raked directly into the bag through its open bag mouth 32 which is held open by the top edge 20 of the container side wall 18. After the bag 30 has been partially filled or filled to the point where it overflows and little more refuse can be added, the compactor plate 14 is placed at the open container top 22 and manually moved into the bag 30 in the direction toward the container bottom 16 to compact the refuse in the bag 30 and expel entrapped air. The central opening 38 in the compactor plate 14 makes a convenient hand hold. The compactor plate 14 is then removed from the bag 30 and container housing 12 and the filling operation is resumed until once again the bag 30 is filled to the point of overflowing. Once the trash bag 30 has been filled with the maximum amount of refuse still leaving a void at the bag mouth 32 leaving enough of the bag top to be twisted and tied, the bag mouth end 32 is unfolded from the top edge 20 of the container 12 and gathered. The compactor plate 14 is then positioned horizontally in the open top end 22 of the container 12 and the gathered bag material is placed through the central opening 38 of the compactor plate 14. The compactor plate 14 is then moved again into the container 12 against the trash bag 30 finally compressing the refuse in the bag 30. The gathered together material of the open bag mouth 32 projecting through the central opening 38 of the compactor plate 14 is then twisted by hand and a wire or plastic tie is wound around the twisted bag material. The compactor plate 14 is then removed from the container 12 and the filled bag of compressed refuse is lifted from the container 12. The tapered side wall 18 of the container housing 12 aids in the easy removal of the filled bag 30.

The foregoing detailed description is given primarily for clearness of understanding and no unnecessary limitations are to be understood therefrom for modifications will become obvious to those skilled in the art upon reading the disclosure and may be made without departing from the spirit of the invention and scope of the appended claims.

What is claimed is:

1. A refuse compactor device comprising:

a container housing having a bottom having a perimeter and a peripheral side wall defining a peripheral configuration extending upwardly from the perimeter of the bottom, the side wall having a peripheral top edge defining an open container top end for holding a flexible bag having an open mouth with the open mouth of the bag in registration with the open container top end and folded over the top edge of the peripheral side wall;

ventilation apertures formed through the peripheral side wall of the container housing;

a compactor plate having a peripheral configuration corresponding to the peripheral configuration defined by the peripheral container side wall to be received through the open container top end into the container and moved from the open container top end toward the container bottom; and, a central opening through the compactor plate defining a hand grasp and for receiving the material of the bag mouth when the bag material defining the bag mouth is unfolded from over the top peripheral edge of the container side wall and gathered together closing the bag mouth.

2. The refuse compactor device of claim 1, further comprising ventilation apertures formed through the container bottom.

3. The refuse compactor device of claim 1, wherein the compactor plate comprises ventilation apertures therethrough.

4. The refuse compactor of claim 1, wherein the compactor plate has a peripheral dimension smaller than the peripheral dimension of the peripheral container side wall proximate the container bottom.

5. The refuse compactor of claim 1, wherein the peripheral container side wall has a generally rectangularly shaped perimeter.

* * * * *